US005217665A

United States Patent [19]

Lim et al.

[11] Patent Number: 5,217,665

[45] Date of Patent: Jun. 8, 1993

[54] PHENOL FORMALDEHYDE STEAM PRESSING OF WAFERBOARD

[75] Inventors: Jau T. C. Lim, Vancouver; Shui-Tung Chiu, Coquitlam, both of Canada

[73] Assignees: Borden Inc., Columbus, Ohio; Trus Joist MacMillan, Boise, Id.

[21] Appl. No.: 841,179

[22] Filed: Feb. 25, 1992

[51] Int. Cl.[5] ..... B27N 3/12

[52] U.S. Cl. ..... 264/83; 264/109; 264/122

[58] Field of Search ..... 264/83, 101, 102, 109, 264/122; 524/14

[56] References Cited

U.S. PATENT DOCUMENTS

| | | | |
|---|---|---|---|
| 3,968,308 | 7/1976 | Buschfeld et al. . | |
| 4,393,019 | 7/1983 | Geimer | 264/83 |
| 4,528,309 | 7/1985 | Helgesson et al. | 524/13 |
| 4,850,849 | 7/1989 | Hsu | 425/407 |
| 4,937,024 | 6/1990 | Hickson . | |
| 5,002,713 | 3/1991 | Palardy et al. | 264/109 |
| 5,063,010 | 11/1991 | Fischer et al. | 264/109 |

FOREIGN PATENT DOCUMENTS 2013235 3/1990 Canada .

OTHER PUBLICATIONS

"Use of Phenol-Formaldehyde Resin in Steam Pressing" Hsu, Adhesives & Bonded Wood Symposium, Seattle, Wa., Nov. 19-21, 1991.

Steam Injection Pressing, Kamka et al., Prepared for FPRS 45th Annual Meeting, New Orleans, La., Jun. 1991.

Steam Injection Pressing, Geimer, Proc. of 16th Washington State Univ. International Symposium on Particleboard, mar. 30-Apr. 1, 1982 Pullman, Washington, pp. 115-134.

Steam Press Process for Curing Phenolic-Bonded Particleboard, Forest Products Journal, vol. 23, No. 3, Mar. 1973 by Shen.

Composites are Technically Feasible with Steam-Injection Pressing, Composite Board Product for Furniture and Cabinets: Inventions in Manufacture and Utilization, Greensboro, N.C., Nov. 11-13, 1986 by Geimer et al.

Steam Injection Pressing-Large Panel Fabrication with Southern Hardwoods in Proceedings of the 20th International Particleboard/Composite Materials Symposium; Apr. 8-10, 1986, Pullman, Washington, by Geimer et al.

*Primary Examiner*—Mary Lynn Theisen

*Attorney, Agent, or Firm*—C. A. Rowley

[57] ABSTRACT

The present invention relates to a method of producing a waferboard by applying first a liquid phenol formaldehyde resin to the surface of the wafers then a powdered phenol formaldehyde resin followed by forming a layup and pressing at elevated temperature and pressure using steam pressing techniques to consolidate the layup into a board and set the phenol formaldehyde adhesive.

28 Claims, 1 Drawing Sheet

PHENOL FORMALDEHYDE STEAM PRESSING OF WAFERBOARD

FIELD OF THE INVENTION

The present invention relates to the manufacture of waferboard. More particularly the present invention relates to the manufacture of waferboard using phenol formaldehyde resin as the binding resin in a steam pressing operation.

BACKGROUND OF THE INVENTION

The term waferboard as used throughout this disclosure is intended to include conventional waferboard, oriented strand board, oriented long wafer products, particleboard, fibreboard, flakeboard, parallel strand lumber products, composite lumber or the like.

It is common practice in conventional heated platen pressing (no steam applied directly to the layup) of waferboard to use either a liquid or a powdered phenolic resin adhesive as the binder as each are quite satisfactory for the purpose. The combination of both a liquid and a powder applied in sequence as the adhesive has also been used in conventionally heated platen pressing of waferboard.

U.S. Pat. No. 3,968,308 issued Jul. 6, 1976 to Buschfield et al describes a process of applying powdered adhesive through a liquid spray in order to adhere the powdered adhesive to the chips. This patent discusses the prior art attempts to solve the problem by moistening the chips prior to binder addition by spraying water on the chips or using chips with high residual moisture particularly in the centre layers or simultaneously moistening an application of powder resin.

The concept of steam pressing to consolidate particleboard is well known and is used commercially. The use of phenol formaldehyde resin for bonding steam pressed particle board is described in an article entitled *Steam Press Process for Curing Phenolic-Bonded Particleboard*, Forest Products Journal, Volume 23, No. 3, March 1973 by Shen. In this article a description is given of a process of consolidating hardwood particles using a liquid phenol formaldehyde resin and the application of this technique to produce boards having significantly better dimensional stability. Similar studies were carried out by Geimer (*Steam Injection Pressing*, proceedings of the 16th Washington State University International Symposium on Particleboard, 1982, Mar. 30 and Apr. 1, Pullman, Washington, Geimer et al (see *Thick Composite are Technically Feasible with Steam-Injection Pressing*' presented at Composite Board Product for Furniture and Cabinets: Inventions in Manufacture and Utilization, Greensboro, N.C., Nov. 11-13, 1986 and *Steam Injection Pressing-Large Panel Fabrication with Southern Hardwoods* in Proceedings of the 20th International Particleboard/Composite Materials Symposium; Apr. 8-10, 1986, Pullman, Washington.)

Despite the indication by Shen and Geimer et al that phenolic resins could be used in binding of flake boards and the like under steam pressing conditions, the art has found that the use of phenol formaldehyde resins in steam pressing is generally unsatisfactory (also described in the above identified publication *Steam Injection Pressing-Large Panel Fabrication with Southern Hardwoods* by Geimer, Apr. 1986) and *Steam Injection Pressing*, Kamke et al, FPRS 45th Annual Meeting, New Orleans, Louisiana, Jun. 1991. Generally it has been found that the internal bond of consolidated products made using phenolic resins in a steam press is simply too low or inconsistent and have recently been reported as less than 50 psi (*Phenolic Resin Interaction During Steam-Injection Pressing of Flakeboard* by Kamke et al and *Use of Phenol-Formaldehyde Resin in Steam Pressing* by Hsu, Adhesives & Bonded Wood Symposium, Seattle, Washington, Nov. 19-21, 1991).

Various steam pressing cycles have been advanced to consolidate particle board as shown for example in U.S. Pat. No. 4,517,147 issued May 14, 1985 to Taylor et al or U.S. Pat. No. 4,684,489 issued Aug. 7, 1987 to Walter.

It has also been suggested by Hickson in U.S. Pat. No. 4,937,024 issued Jun. 26, 1990 using a steam pressing technique and wherein esters in gaseous form is injected into the mat at final density to cure at least a portion of the phenol formaldehyde binder.

Generally the resin used in bonding of steam pressed waferboards and the like is an isocyanate type resin which has much more tolerance to moisture thereby facilitating the formation of a consolidated board and curing of the resin.

The costs of isocyanate resins are however, significantly higher than those of phenol formaldehyde resins and thus it would be advantageous to provide a system permitting the use of phenol formaldehyde based resins as the bonding agent for steam pressing of waferboards as opposed to the isocyanate resins now used commercially.

BRIEF DESCRIPTION OF THE PRESENT INVENTION

It is an object of the present invention to provide a method of steam pressing waferboard to produce a consolidated product having an acceptable internal bond and utilizing phenol formaldehyde resins.

Broadly the present invention relates in one embodiment to a process of producing, from particulate lignocellulosic material, a consolidated product having an internal bond strength of at least 85 psi and preferably greater than 100 psi by first drying said lignocellulosic material, applying liquid phenol formaldehyde resin having a resin solids content of preferably at least 35% by weight onto the surface of said lignocellulosic material, forming a layup from said material having said formaldehyde resin applied thereto, coordinating said drying and said application of liquid resin to ensure said layup has a moisture content of no more than 7% based on the oven dry weight of said material and steam pressing said layup at elevated temperature and pressure sufficient to set or cure said resins and consolidate said layup into said product.

Preferably a dry phenol formaldehyde resin will also be applied to said material.

Preferably said liquid phenol formaldehyde resin will have a solids content of at least 45% by weight, and preferably 50% by weight.

Preferably said resin solids content of said liquid phenol formaldehyde resin will comprise 25 to 75% of the total resin applied to said lignocellulosic material.

Preferably said liquid phenol formaldehyde resin will be a resole phenol formaldehyde resin.

Preferably said moisture content will be no greater than 6% and more preferably no greater than 5% of the oven dry weight of the wood.

BRIEF DESCRIPTION OF THE DRAWINGS

Further features, objects and advantages will be evident from the following detailed description of the preferred embodiment of the present invention taken in conjunction with the accompanying drawings in which.

DESCRIPTION OF THE PREFERRED EMBODIMENT

Figure 1:
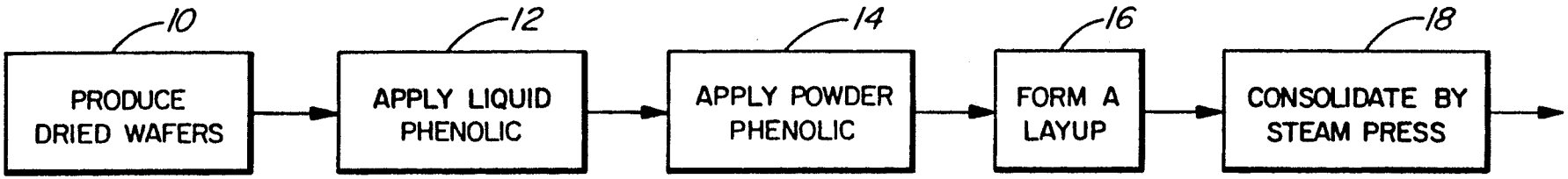
FIG. 1 is a schematic illustration of the process of the present invention.

By 'particulate lignocellulosic material' herein is meant steam permeable, or at least semi-permeable lignocellulosic material such as fibres, flakes, chips, and strands of wood derivatives or mixtures thereof.

In one embodiment the present invention is relatively simple in that instead of a single application of resin or adhesive, multiple applications in a sequence are used. In particular, dried lignocellulosic wafers or the like are produced as indicated at 10 and then are coated with a suitable liquid phenol formaldehyde resin as indicated at 12. The liquid phenol formaldehyde resin may be any suitable phenol formaldehyde resin and generally will have a solids content of at least about 35%, preferably over 45%, and most preferably about 50%. Preferably the liquid resin will be resole phenol formaldehyde resin. The liquid resin is applied to the wafers or other lignocellulosic material to coat them and provide a relatively sticky surface tack to hold the dry resin on the wafer or other material.

After the liquid resin has been applied, dry phenol formaldehyde resin compatible with the liquid resin is applied as indicated at 14. The precise spacing (time) between the application of liquid phenol formaldehyde resin and the application of the dry phenol formaldehyde resin is not critical, however it is important that the dry phenol formaldehyde be applied before the liquid resin previously applied loss its tackiness, thereby reducing or inhibiting the adherence of the dry resin to the wafers or other lignocellulosic material.

By 'dry' resin herein is meant any powdered, granular, flake, chipped, spray dried, freeze dried, ground, or other phenol formaldehyde resin powder or solid, with or without hexamethylene tetramine. Thus novalac and resole resins can be used herein.

Sources of phenol functionality useful herein can include but not by limitation, cresol, catechol, resorcinol, bisphenol and the like, replacing some or all of the phenol. Formaldehyde can partially be replaced by other aldehydes such as acetaldehyde, propionaldehyde and the like and mixtures thereof.

In another embodiment, the liquid and dry resins can be applied simultaneously to the lignocellulosic materials, using application techniques known in the art.

In yet another embodiment of the present invention, the dry resin can be applied to the lignocellulosic material before the liquid resin is applied and the lignocellulosic material is sufficiently tacky to hold the dry resin in place until the liquid resin is applied. Such tackiness can also be achieved, for example, by the application to the lignocellulosic material of a wax or other tackifier.

High molecular weight resins have been found to cause more frequent defects in the product, thus lower molecular weight phenol formaldehyde resins having molecular weight in the range of from about 1000 to 1800 are preferred. The mole ratio of formaldehyde to phenol is preferably 1.80 to 2.20 but can go as broad as 1.50:1 to 2.25:1.

The solids content of the liquid resin should constitute at least 25% of the total of the phenol formaldehyde resin applied, i.e. total of the dry or powdered phenol formaldehyde resin and solids content of the liquid resin applied to the wafers or other lignocellulosic material.

The amount of liquid phenol formaldehyde resin applied also must take into consideration the total moisture content of the lignocellulosic material being fed to the laying head and to form a layup as indicated at 16, in particular it is important that the total moisture content of the material after the layup is formed as indicated at 16 and is fed into the steam pressing stage 18 not exceed a preset limit. If the moisture content is too high it is likely that there will be defects formed in the final product during the pressing operation. The maximum moisture content in the mat entering the steam press should not exceed about 7%, preferably not more than 6%, and most preferably not more than 5% based on the oven dry weight of the particulate lignocellulosic material. The amount of moisture that may be tolerated may vary for different wood species, pressing cycles and resin types.

The actual layup formed at 16 may be designed to produce a panel with an intermediate cross layer(s) or randomly intermediate layer(s) or a panel with all of the strands or wafers throughout the thickness of the panel arranged with their longitudinal axis substantially parallel to form a product that may be sawn, parallel to the longitudinal axis of the wafers to produce lumber products from the consolidated product formed by the steam pressing 18.

In the steam pressing stage the steaming should be completed in less than about 4 minutes for 0.75 inch thick panels-too long a period may be damaging to the product and too short will result in improper bonding. A venting about halfway through the steaming cycle is advantageous and should be included.

EXAMPLE 1

Tests were conducted comparing the use of a liquid phenol formaldehyde resin or a dry phenol formaldehyde resin per se and a combination of the two. In Table 1 the resins used were as follows: Liquid resin used was Borden LH94D and the powder resin was Borden W735B.

The total amount of resin applied in all cases was 5.9% based on the oven dry weight of the wood.

All of these tests were performed using a steam injection press having multiple steam orifices on the platens. The platen temperature was 205° C. and supply steam pressure was 200 psi. The press was first closed quickly to a thickness of about 1 inch (for a 0.75 inch board) followed by steam injection for 3 to 4 minutes with two consecutive venting periods each of about 15 seconds midway through the cycle.

One important characteristic to be considered is the improvement in internal bond strength achieved the present invention relative to the strength obtained using only one type of phenolic resin. Another important feature of the present invention is the absence of undesirable isocyanates while maintaining good bond strengths.

Table 1 shows the results obtained in a number of tests performed using different ratios of powder to liquid resins.

TABLE 1

| Powder:liquid Ratio | Wafer M/C % | Mat M/C % | IB, psi |
|---|---|---|---|
| 100:0 | 6.5 | 6.6 | 73 ± 8 |
| 75:25 | 4.4 | 5.2 | 89 ± 4 |
| 50:50 | 2.9 | 4.9 | 91 ± 8 |
| 25:75 | 1.9 | 4.9 | 90 ± 12 |
| 0:100 | 0.6 | 4.9 | 80 ± 9 |

It can be seen from Table 1 that when liquid or powder resin per se was used, the internal bond (IB) was 73–80 psi. However, when a combination of liquid and powder was used the IB increased at least 10 psi to 90+ psi.

For a comparison the specification for a commercial waferboard product (OSB Aspenite) which use an amount of dry resin significantly less than that used above is about 50 psi.

CRITICALITY OF MAT MOISTURE CONTENT

EXAMPLE 2

The condition and resin used were the same as in Example 1. In this Example total resin content was constant at 5.9% and a 50:50 combination of powder and liquid resins was used to investigate the influence of mat M/C on IB of resulting boards. Mat moisture content was determined by initial wafer moisture content and the amount of liquid resin added. The results obtained are presented in Table 2.

TABLE 2

| Wafer M/C % | Mat M/C % | Total Resin % | IB psi |
|---|---|---|---|
| 0.7 | 3.3 | 5.9 | 91 ± 4 |
| 2.9 | 4.9 | 5.9 | 91 ± 8 |
| 4.1 | 5.8 | 5.9 | 82 ± 3 |
| 6.4 | 7.8 | 5.9 | 67 ± 6 |

It can be seen that the moisture content is critical and dropped significantly when the Mat M/C reached 7.8%. Thus the mat moisture content should not exceed 7%, preferably 6% and most preferably 5% based on the oven dry weight of the wood.

EXAMPLE 3

Keeping the mat M/C, press cycle, and resin type and ratio (50:50 powder and liquid) constant, the effect of higher resin loading on property improvements was investigated. The results are shown in Table 3.

TABLE 3

| Resin Dose % | Mat M/C % | IB psi | 24 Hr Soak, % Gain | |
|---|---|---|---|---|
| | | | Weight | Thickness |
| 5.9 | 4.9 | 91 ± 8 | 24.4 | 14.4 |
| 8.0 | 4.9 | 101 ± 3 | 22.0 | 10.7 |

By increasing the resin loading from 5.9% to 8%, IB and dimensional stability were further improved.

Having described the invention, modifications will be evident to those skilled in the art without departing from the spirit of the invention as defined in the appended claims.

We claim:

1. A process of producing, from particulate lignocellulosic material, a consolidated product having an average internal bond strength of at least 85 psi, comprising drying said material, applying liquid phenol formaldehyde resin having a resin solids content of at least 35% by weight on the surface of said material, applying a dry phenol formaldehyde resin to said material, then forming a layup from said material having said resins applied thereto, coordinating said drying and said application of liquid resin to ensure said layup has a moisture content of no more than 7% based on the oven dry weight of the material and steam pressing said layup at elevated temperature and pressure sufficient to set or cure said resins and consolidate said layup into said product.

2. A process as defined in claim 1 wherein said dry phenol formaldehyde resin is applied to said material after application of said liquid resin.

3. A process as defined in claim 2 wherein said liquid resin has a solids content of at least 45% by weight.

4. A process as defined in claim 2 wherein said resin solids content of said liquid phenol formaldehyde resin will comprise 25 to 75% by weight of the total resin applied to said material.

5. A process as defined in claim 3 wherein said resin solids content of said liquid phenol formaldehyde resin will comprise 25 to 75% by weight of the total resin applied to said material.

6. A process as defined in claim 2 wherein said liquid resin comprises a phenol formaldehyde resole resin.

7. A process as defined in claim 3 wherein said liquid resin comprises a phenol formaldehyde resole resin.

8. A process as defined in claim 4 wherein said liquid resin comprises a phenol formaldehyde resole resin.

9. A process as defined in claim 5 wherein said liquid resin comprises a phenol formaldehyde resole resin.

10. A process as defined in claim 2 wherein said moisture content is no greater than about 6% based on the oven dry weight of the material.

11. A process as defined in claim 3 wherein said moisture content is no greater than about 6% based on the oven dry weight of the material.

12. A process as defined in claim 4 wherein said moisture content is no greater than about 6% based on the oven dry weight of the material.

13. A process as defined in claim 5 wherein said moisture content is no greater than about 6% based on the oven dry weight of the material.

14. A process as defined in claim 6 wherein said moisture content is no greater than about 6% based on the oven dry weight of the material.

15. A process as defined in claim 7 wherein said moisture content is no greater than about 6% based on the oven dry weight of the material.

16. A process as defined in claim 8 wherein said moisture content is no greater than about 6% based on the oven dry weight of the material.

17. A process as defined in claim 9 wherein said moisture content is no greater than about 6% based on the oven dry weight of the material.

18. A process as defined in claim 2 wherein said moisture content is no greater than 5% based on the oven dry weight of the material.

19. A process as defined in claim 3 wherein said moisture content is no greater than 5% based on the oven dry weight of the material.

20. A process as defined in claim 4 wherein said moisture content is no greater than 5% based on the oven dry weight of the material.

21. A process as defined in claim 5 wherein said moisture content is no greater than 5% based on the oven dry weight of the material.

22. A process as defined in claim 6 wherein said moisture content is no greater than 5% based on the oven dry weight of the material.

23. A process as defined in claim 7 wherein said moisture content is no greater than 5% based on the oven dry weight of the material.

24. A process as defined in claim 8 wherein said moisture content is no greater than 5% based on the oven dry weight of the material.

25. A process as defined in claim 9 wherein said moisture content is no greater than 5% based on the oven dry weight of the material.

26. A process as defined in claim 1 wherein dry resin is applied to the lignocellulosic material after said material has been sufficiently tackified to cause the dry resin to adhere, followed by the application of said liquid resin.

27. A process as defined in claim 1 wherein the dry resin and liquid resin are applied simultaneously to the lignocellulosic material.

28. A process as defined in claim 26 wherein the lignocellulosic material has been tackified by the application to it of a wax.

* * * * *